United States Patent [19]

Giangerelli

[11] Patent Number: 4,519,157

[45] Date of Patent: May 28, 1985

[54] BLACK POWDER GUN NIPPLE

[76] Inventor: Frank Giangerelli, 14 River Edge Dr., Fairfield, N.J. 07006

[21] Appl. No.: 542,371

[22] Filed: Oct. 17, 1983

[51] Int. Cl.[3] ..... F41C 27/00

[52] U.S. Cl. ..... 42/83

[58] Field of Search ..... 42/83, 51

[56] References Cited

U.S. PATENT DOCUMENTS

| | | | |
|---|---|---|---|
| 15,292 | 7/1856 | Halsey | 42/51 |
| 21,802 | 10/1858 | Schenkl | 42/51 |
| 36,464 | 9/1862 | Hopkins | 42/51 |
| 4,163,335 | 8/1979 | Ives | 42/83 |
| 4,186,506 | 2/1980 | Pawlak | 42/83 |

FOREIGN PATENT DOCUMENTS

| | | | |
|---|---|---|---|
| 1261018 | 2/1968 | Fed. Rep. of Germany | 42/51 |

*Primary Examiner*—Charles T. Jordan

*Attorney, Agent, or Firm*—Lerner, David, Littenberg, Krumholz & Mentlik

[57] ABSTRACT

A nipple for use in conjunction with firearms to permit passage of an ignition impetus to a propellant, especially those firearms which employ black powder and which use percussion caps to provide an ignition impetus, the nipple including an elongated body formed to accept a percussion cap on one end thereof in a conventional manner, the other end of the body, typically for threading into the breech of a rifle or the rear portion of a cylinder of a pistol and configured such that it extends into the propellant chamber. The portion of the body which extends into the propellant chamber has disposed therein vent means opening through walls thereof and into a longitudinal chamber which extends from the percussion cap holding end of the body to the opposite end thereof, the vent means being dimensioned such that the granular structure of the propellant precludes the entry thereof into the vent means, the ignition impetus created by the percussion cap being transported to the propellant via the longitudinal chamber and the vent means disposed in the body. The vent means can be configured as at least one slot or as a plurality of apertures.

12 Claims, 7 Drawing Figures

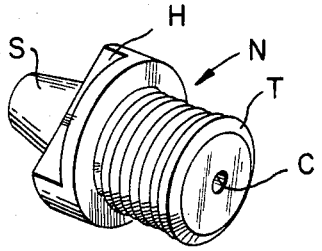
FIG. 1
PRIOR ART
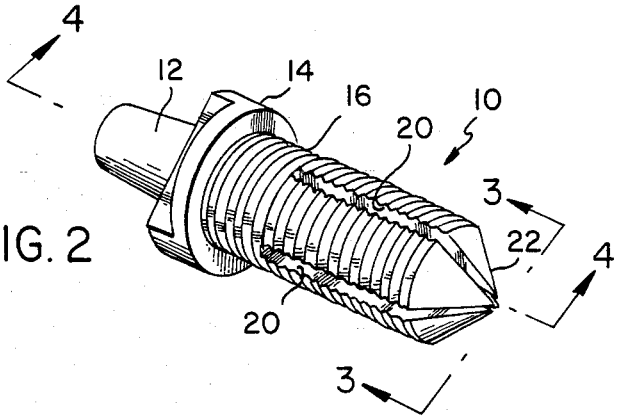
FIG. 2
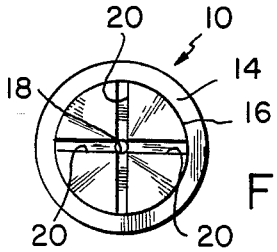
FIG. 3
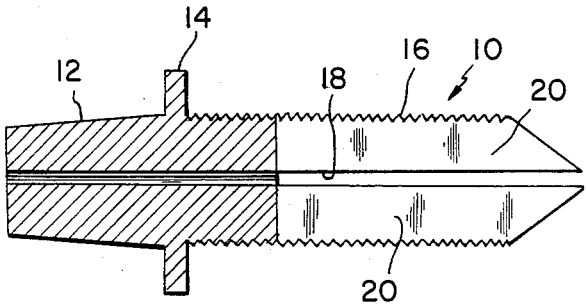
FIG. 4
FIG. 5
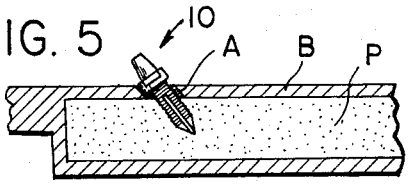
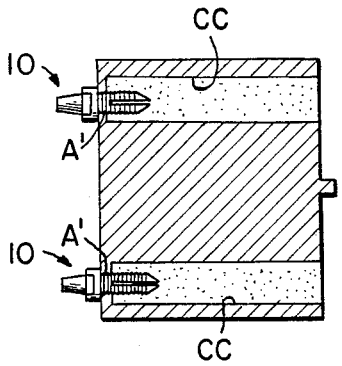
FIG. 6
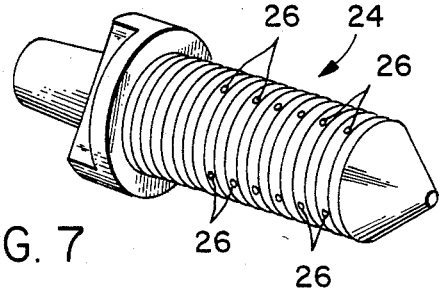
FIG. 7

BLACK POWDER GUN NIPPLE

BACKGROUND OF THE INVENTION

1. Field of the Invention

The present invention relates to means for transferring an ignition impetus through the wall of a firearm to a confined propellant, and more particularly to a nipple for use in conjunction with firearms.

2. Description of the Prior Art

Since the early use of firearms, it has been necessary to transfer an ignition impetus from the exterior of the barrel or cylinder of a firearm to a propellant charge, such as black powder, disposed therein. Early in the 19th century, flintlocks, which touched off a small black powder charge were employed and this was later largely replaced by the use of percussion caps which, upon impact, produce a desired quantity of burning gas or "flash" which is employed to ignite the propellant charge. These percussion caps are customarily fitted to what is known as a nipple which is treated through an aperture disposed into the barrel of a rifle or hand gun, adjacent to the breech portion thereof, or in the rearward wall of a cylinder in a revolver. When the percussion cap is snugly in place on the nipple, the force of striking the percussion cap not only produces a flash but also forces this gas under considerable pressure through the nipple into the ignition chamber of the firearm.

Typically, the interior portion of the nipple terminates in an aperture. Unfortunately, a frequently incurred problem is the blockage of this aperture for various reasons. The result is the placing of a percussion cap on the nipple and the striking thereof with the end result of no ignition of the propellant charge.

Various methods of clearing such a blockage have developed over the years and there is keen interest in this problem today as the use of antique or reproduction of antique black powder firearms has become a large hobby. Solutions include the removal of the nipple and the clearing of the aperture in which the nipple was disposed, the forcing of a fine wire through the nipple and the somewhat, dangerous practice of removing the nipple, placing a small amount of fresh black powder adjacent to the location of the interior opening of the nipple, in the propellant, and replacing of the nipple. Unfortunately, none of these methods is totally satisfactory and, if a powder charge is in place covered by a lead ball or bullet it has been known to be necessary to employ a screw-type extractor or the like to remove the ball and permit removal of the powder charge so that a barrel or cylinder can be totally cleared for reuse with fresh powder.

In an attempt to solve other problems associated with these early firearms, various configurations were proposed for extending the flashhole in the nipple through the powder charge. U.S. Pat. No. 36,464 issued to Hopkins on Sept. 16, 1862; U.S. Pat. No. 21,802 issued to Schenkl on Oct. 12, 1858; and U.S. Pat. No. 15,292 to Halsey on July 8, 1856 teach the employment of a tige or tube disposed in the barrel of a rifle so that the point at which the flash from a percussion cap or the like touches off the powder is extended to a point somewhere remote from the point of entry of the flash into the barrel. These configurations are provided so that the powder can be ignited entirely before it is blown out of the rifle barrel. Further, in Halsey it is suggested that the tige principle can be used in conjunction with a nipple wherein the tige is a mere continuation of the nipple what is deemed a proper distance into the interior of the barrel to form a tube. Although these references teach methods of enhancing combustion, the basic problem of an orifice which can be clogged by a powder charge still exists.

The present invention overcomes the problems associated with the prior art by providing a nipple which provides an extended opening from which an ignition impetus such as that generated by a percussion cap can contact the powder thereby limiting the possibility of the extended orifice becoming clogged.

Other percussion nipples are shown in U.S. Pat. No. 4,163,335 to Ives and U.S. Pat. No. 4,186,506 to Pawlak. In addition, a percussion nipple is also shown in German Auslegeschrift No. 1,216,018 to Hintze. However, none of the references cited show or suggest the configuration of the present invention which has solved an extremely long standing problem.

SUMMARY OF THE INVENTION

Therefore, a primary object of the present invention is to provide a nipple for use in conjunction with firearms which require the passage of an ignition impetus from the exterior of the firearm to a propellant disposed therein.

A further object of the present invention is to provide a nipple which will permit passage of an ignition impetus substantially unimpeded by the presence of a propellant adjacent to the portion of the nipple disposed within the propellant chamber.

A still further object of the present invention is to provide a nipple which is configured to distribute an ignition impetus throughout a relatively large area of a propellant as compared to that previously known.

Still another object of the present invention is to provide a nipple which is ideally suited for use with granulated black powder.

Still another further object of the present invention is to provide a nipple with can find application both in long arms and pistols as well as in revolvers.

Another further object of the present invention is to provide a nipple which is configured such that it can pierce a flashpaper type cartridge.

An additional object of the present invention is to provide a nipple which is simple in design, inexpensive to manufacture, rugged in construction, easy to use and efficient in operation.

These objects as well as further objects and advantages of the present invention will become readily apparent after reading the ensuring description of a non-limiting illustrative embodiment and viewing the accompanying drawings.

A nipple for use in conjunction with firearms to permit the passage of an ignition impetus to a propellant disposed in a chamber of the firearms, according to the principles of the present invention, comprises an elongated body having a longitudinal chamber disposed therethrough and opening through the ends thereof, one end of the body for cooperating with the ignition impetus, a portion of the body adjacent to the other end thereof for disposition in a propellant, the portion of the body adjacent to the other end thereof having disposed therein a vent means opening through a wall thereof and the longitudinal chamber.

BRIEF DESCRIPTION OF THE DRAWING

In order that the present invention may be more fully understood, it will now be described, by way of example, with reference to the accompanying drawing in which:

FIG. 1 is a perspective view of a prior art nipple;

FIG. 2 is a perspective view of the preferred embodiment of the present invention incorporating the principles of the present invention therein;

FIG. 3 is an end view taken substantially along the lines 3—3 of FIG. 2;

FIG. 4 is a cross-sectional view of the embodiment shown in FIG. 2 taken substantially along the lines 4—4 thereof;

FIG. 5 shows the nipple of the present invention in position in the barrel of a rifle shown in fragmentary cross-section;

FIG. 6 shows two nipples constructed in accordance with the teachings of the present invention in position in the powder chambers of a cylinder of a pistol shown in cross-section, and FIG. 7 is a perspective view of an alternate embodiment of the present invention.

DESCRIPTION OF THE PREFERRED EMBODIMENTS

Referring now to the figures, and more particularly FIG. 1 thereof, there is illustrated therein a nipple N of conventional design. The nipple N includes a shank S onto which a percussion cap, not illustrated, is placed and a longitudinal chamber C through which the flash from a percussion cap is transferred to a propellant such as a black powder charge. The nipple includes threads T and a wrench-engageable head H such that the threads T can engage complimentary threads disposed in the barrel of a rifle or pistol adjacent to the breech portion thereof or the rearward portion of a cylinder. When the percussion cap disposed on the shank S is struck, the flash therefrom emerges from the nipple N through the end of the longitudinal chamber C adjacent to the threads T. If this orifice is not clogged, the powder is ignited. Unfortunately, the orifice tends to clog frequently, especially from the presence of damp or slightly carbonized black powder and remedial action must be taken to insure proper ignition.

Referring now to FIGS. 2, 3, and 4, there is illustrated therein a nipple 10 constructed in accordance with the principles of the present invention. Typically, the nipple 10 would be machined from hardened steel and includes a shank portion 12 configured to accept a percussion cap thereon. Typically, the shank 12 would have a slight taper to insure frictional engagement between the percussion cap, not shown, and the outer walls thereof. The balance of the nipple 10 includes a wrench-engageable head 14 and a threaded body 16. The threaded body is longer than that of prior art nipples so that it extends into the propellant employed when in a use position.

The threaded body 16 is provided so that the nipple 10 can be secured through an aperture disposed in the barrel of a rifle or pistol or in the cylinder of a pistol, as further shown in FIGS. 5 and 6. Although the threaded portion 16 is shown with threads throughout its length, it is to be understood that threading only of that portion necessary to provide engagement with the aperture in which the nipple is to be disposed is necessary.

Longitudinally disposed through the nipple 10 is a longitudinal chamber 18, best seen in FIG. 4, which serves as a means for transporting the flash from a percussion cap on the shank portion 12 to the end of the nipple 10 adjacent to the threaded portion 16 thereof.

Also disposed in the threaded portion 16 of the nipple 10 are a plurality of slots 20 which open through the side and end walls of the nipple 10 and also into the longitudinal chamber 18 such that the longitudinal chamber 18 is in direct radial communication via the slots 20 with the powder charge disposed therearound when the nipple 10 is in place. As a manufacturing expedient it appears to be desirable to employ four slots forming an X shaped transverse cross-section, as illustrated in FIG. 3, which open through the side and end walls, but it is to be understood that those skilled in the art, within the principles and the scope of the invention may employ any number of slots opening through either the side walls, end walls or both. The slots are sized so as not to permit the entry of propellant therein therefore precluding the clogging of the longitudinal chamber and, since the likelihood of clogging of the lengths of all the slots is highly improbable, ignition of the propellant is virtually insured. Such sizing is not difficult since black powder is granulated and sold according to the size of the granules.

The end 22 of the nipple 10 is preferably conically shaped as illustrated to provide for piercing of a paper cartridge if employed. Paper cartridges have been employed wherein a desired amount of black powder is placed within flashpaper along with a lead ball or a lead bullet and then the flashpaper is rolled therearound and twisted at the ends to provide a prearranged cartridge tape configuration. A problem encountered with such flashpaper cartridges is that frequently the ignition impetus from the nipple will not sufficiently ignite the flashpaper to ignite the powder charge. The conical shape of the end 22 of the nipple, which extends a distance greater than that of the conventional nipple, will therefore serve to pierce the flashpaper cartridge, especially in a revolver configuration as seen in FIG. 6, therefore guaranteeing the desired ignition.

Referring to FIG. 5 there is illustrated therein a cross-section of the breech portion of a rifle barrel with a nipple 10 configured in accordance with the principles of the present invention threaded into an aperture A disposed in the barrel. As can be seen, the threaded portion 16 of the nipple 10 extends a substantial distance into a powder charge P disposed within the barrel B and, through employment of the slots 20, as illustrated in FIGS. 2 through 4, extreme reliability in ignition is provided.

The same nipples 10 can also be employed in pistol-type firearms as is illustrated in the cross-section of a cylinder of a pistol shown in FIG. 6. Here, two nipples 10, constructed in accordance with the principles of the present invention, are shown disposed through the rearward wall of the cylinder in apertures A'. Again, the threaded portion 16 of the nipples 10 extend an appreciable distance into the cylinder chambers CC and therefore because of the slots 20, ignition of a powder charge disposed therein is virtually assured. Further, it can be seen that the placement of paper cartridges in the cylinders CC causes the nipples 10 to readily pierce the paper cartridges when the paper cartridges are rammed home in a conventional manner.

FIG. 7 illustrates an alternate embodiment of the present invention, a nipple 24. Instead of employing slots 20, as does nipple 10, nipple 24 employs a plurality of apertures 26, but in other respects is essentially the same as nipple 10. The apertures 26 may assume various configurations but preferably are disposed along the length of nipple 24, as illustrated, and each open through the side walls, end walls or both of the nipple 26 and also into the longitudinal chamber thereof.

Although the present invention is described herein for use with black powder firearms employing percussion caps, it is to be understood that the invention can be used with ignition impetuses other than created by percussion caps and with propellants other than black powder, within the principles and scope of the invention. It will be further understood that various changes in the details, materials, arrangements of parts, and operational conditions which have been herein described and illustrated in order to explain the nature of the invention may be made by those skilled in the art within the principles and scope of the invention.

Having thus set forth the nature of the invention, what is claimed is:

1. A nipple for use in conjunction with firearms to permit passage of an ingnition impetus to a propellant disposed in a chamber of the firearm, the nipple comprising an elongated body, having a longitudinal chamber disposed therethrough and opening through the ends thereof, one said end of said body configured for cooperating with the ignition impetus, a portion of said body adjacent to the other said end thereof for disposition in a propellant, said portion of said body having disposed therein at least one vent means opening through a wall thereof and said longitudinal chamber.

2. A nipple in accordance with claim 1, wherein said vent means comprises at least one slot.

3. A nipple in accordance with claim 2, wherein said at least one slot comprises four slots arranged so as to form an X pattern when viewed in transverse cross-section.

4. A nipple in accordance with claim 3, wherein said propellant is granulated, each of said slots being sized so as not to permit the entry of said propellant therein.

5. A nipple in accordance with claim 2, wherein said propellant is granulated, each of said slots being sized so as not to permit the entry of said propellant therein.

6. A nipple in accordance with claim 2, wherein the end of said portion of said body adjacent to said other end of said body is tapered to a conical configuration.

7. A nipple in accordance with claim 2, wherein said one end of said body is shaped to releasably retain a percussion cap thereon.

8. A nipple in accordance with claim 1, wherein said vent means comprises a plurality of apertures.

9. A nipple in accordance with claim 8, wherein said plurality of apertures are disposed along the length of said elongated body.

10. A nipple in accordance with claim 8, wherein said propellant is granulated, each of said plurality of apertures being sized so as not to permit the entry of said propellant therein.

11. A nipple in accordance with claim 8, wherein the end of said portion of said body adjacent to said other end of said body is tapered to a conical configuration.

12. A nipple in accordance with claim 8, wherein said one end of said body is shaped to releasably retain a percussion cap thereon.

* * * * *